US008955620B2

(12) United States Patent
Littlely et al.

(10) Patent No.: US 8,955,620 B2
(45) Date of Patent: Feb. 17, 2015

(54) DRILL ROD GUIDE

(75) Inventors: Keith William Littlely, Guilderton (AU); Andrew Frank Hay, Rolystone (AU); Mathew C. Everett, Willetton (AU)

(73) Assignee: Longyear TM, Inc., South Jordan, UT (US)

( * ) Notice: Subject to any disclaimer, the term of this patent is extended or adjusted under 35 U.S.C. 154(b) by 637 days.

(21) Appl. No.: 13/326,092

(22) Filed: Dec. 14, 2011

(65) Prior Publication Data

US 2012/0168227 A1 Jul. 5, 2012

Related U.S. Application Data

(60) Provisional application No. 61/428,356, filed on Dec. 30, 2010.

(51) Int. Cl.
*E21B 15/00* (2006.01)
*E21B 19/24* (2006.01)

(52) U.S. Cl.
CPC ..... *E21B 19/24* (2013.01)
USPC ..... 175/220; 175/85

(58) Field of Classification Search
CPC ..... E21B 19/00; E21B 19/10; E21B 19/18
USPC ..... 175/57, 85, 220, 122, 256, 325.1, 175/325.5, 423; 414/22.51, 745.2, 745.4, 414/745.5, 745.6
See application file for complete search history.

(56) References Cited

U.S. PATENT DOCUMENTS

| | | | | |
|---|---|---|---|---|
| 1,945,876 | A * | 2/1934 | Young | 173/166 |
| 3,475,038 | A * | 10/1969 | Matherne | 285/27 |
| 4,297,771 | A | 11/1981 | Anderson et al. | |
| 4,345,493 | A | 8/1982 | Rassieur | |
| 4,475,604 | A | 10/1984 | Albertson et al. | |
| 4,625,796 | A | 12/1986 | Boyadjieff | |
| 4,650,235 | A | 3/1987 | Shaginian et al. | |
| 4,681,173 | A * | 7/1987 | Disher et al. | 175/7 |
| 4,685,662 | A | 8/1987 | Vaughn | |
| 4,834,195 | A | 5/1989 | Robinson | |
| 4,870,738 | A | 10/1989 | Rassieur | |
| 5,039,068 | A | 8/1991 | Venturini et al. | |
| 5,575,344 | A | 11/1996 | Wireman | |

(Continued)

OTHER PUBLICATIONS

International Search Report and Written Opinion for International Application No. PCT/US2011/066217 (mailed Aug. 17, 2012).

*Primary Examiner* — Cathleen Hutchins
*Assistant Examiner* — Ronald Runyan
(74) *Attorney, Agent, or Firm* — Ballard Spahr LLP

(57) ABSTRACT

Implementations of the present invention include a drill rod guide configured to align a first drill rod and a second drill rod. The drill rod guide includes a cylindrical section and a tapered or frusta-conical section. The cylindrical section is sized and configured to concentrically surround a first drill rod. The tapered or frusta-conical section is sized and configured to guide a second drill rod into the cylindrical section and into alignment with the first drill rod. The drill rod guide may include first and second guide members that form symmetrical halves of the drill rod guide. The first and second guide members may be connected to first and second jaws of the clamp. The guide may include a window configured to allow a user to visually confirm that the first and second drill rods are aligned.

24 Claims, 7 Drawing Sheets

(56) References Cited

U.S. PATENT DOCUMENTS

| | | | |
|---|---|---|---|
| 5,791,822 | A | 8/1998 | Edmondson et al. |
| 6,065,537 | A | 5/2000 | Evans et al. |
| 6,283,702 | B1 | 9/2001 | Devlugt et al. |
| 6,550,128 | B1 | 4/2003 | Lorenz |
| 6,604,586 | B2 | 8/2003 | Tremblay |
| 6,736,219 | B1 | 5/2004 | White |
| 6,860,343 | B2 | 3/2005 | Jonsson et al. |
| 7,370,707 | B2 | 5/2008 | McDaniel et al. |
| 7,527,093 | B2 | 5/2009 | Mosing et al. |
| 7,544,036 | B1 | 6/2009 | Randall et al. |
| 7,617,866 | B2 | 11/2009 | Pietras |
| 7,669,662 | B2 | 3/2010 | Pietras |
| 2002/0063435 | A1 | 5/2002 | Nelson |
| 2008/0054662 | A1 | 3/2008 | Lutzhoft et al. |

* cited by examiner

DRILL ROD GUIDE

CROSS-REFERENCE TO RELATED APPLICATIONS

This application claims the benefit of U.S. Provisional Application No. 61/428,356, filed Dec. 30, 2010, entitled "Guide," the contents of which are hereby incorporated by reference in their entirety.

BACKGROUND OF THE INVENTION

1. The Field of the Invention

Implementations of the present invention relate generally to drilling systems and related methods. In particular, implementations of the present invention relate to a drill rod guide for aiding in aligning drill rods.

2. The Relevant Technology

In conventional drilling systems, a drill string may include a series of connected drill rods. The drill rods may be assembled section-by-section to advance the drill string into a formation. In further detail, the drill string may be connected to a drill head or other driving mechanism configured to advance the drill string to a desired depth in the formation. The driving mechanism may, for example, advance the drill string until a trailing portion of the drill string is proximate an opening of a borehole formed by the drill string.

After the drill string is at a desired depth, a grip (such as a foot clamp) may grasp the drill string, which may help prevent inadvertent loss of the drill string down the borehole. With the clamp grasping the drill string, the driving mechanism may be disconnected from the drill string. An additional drill rod may then be connected to the driving mechanism and to a drill rod that forms the trailing portion of the drill string. After such connection, the clamp's grasp on the drill string may be released, and the driving mechanism may advance the drill string further into the formation to a greater desired depth. This process of grasping the drill string, disconnecting the driving mechanism, connecting an additional drill rod, releasing the grasp, and advancing the drill string to a greater depth may be repeatedly performed to drill deeper and deeper into the formation.

Unfortunately, it can be difficult and/or awkward to properly align and connect the additional drill rod to the drill rod that forms the trailing portion of the drill string. When not properly aligned, the pin end (male end) of a drill rod can stab into the box end (female end) and cause permanent damage. This damage can create leakage ranging from negligible to significant, depending upon the degree of damage. Severe damage can compromise the fit of the joint and potentially cause fatigue failures.

Conventional methods for aligning drill rods often require an operator to manually align the drill rods. Manually aligning the additional drill rod to the drill rod that forms the trailing portion of the drill string can be dangerous. For example, operators can easily smash their fingers between the drill rods when trying to align the drill rods. Additionally, due to the nature of many drilling sites, it is not uncommon for a drill rod to move in an unpredictable manner or unintentionally fall from the drill mast, possibly resulting in injury to the operator attempting to align the drill rods.

Accordingly, there are a number of disadvantages in conventional drilling systems that can be addressed.

BRIEF SUMMARY OF THE INVENTION

One or more implementations of the present invention overcome one or more problems in the art with drilling tools, systems, and methods for effectively and efficiently aligning drill rods. For example, one or more implementations of the present invention include drill rod guides configured to align a first drill rod and a second drill. Such drill rod guides can reduce or eliminate damage to drill rods due to misalignment. Furthermore, such drill rod guides can be automated and function without the assistance of a drill operator. As such, drill rod guides of one or more implementations can increase safety, while also improving drilling efficiency.

For example, one implementation of a drill rod guide includes a first guide member and a second guide member. Each of the first and second guide members includes a first end portion having a first inner surface, and an intermediate portion having a second inner surface. The second guide member is configured to move relative to the first guide member. The first inner surfaces of the intermediate portions of the first and second guide members form a cylindrical inner surface when the first and second guide members are abutted together. Also, the second inner surfaces of the first end portions of the first and second guide members form a frusta-conical inner surface when the first and second guide members are abutted together.

Additionally, an implementation of a drill rod clamping device includes a first jaw and a second jaw. The first and second jaws are configured to move between an open configuration and a closed configuration. Also, the first and second jaws are sized and configured to grip a first drill rod when in the closed configuration. The drill rod clamping device also includes a drill rod guide having a first guide member and a second guide member. The first guide member is coupled to the first jaw and the second guide member is coupled to the second jaw. The first and second guide members form a cylindrical section when the first and second jaws are in the closed configuration. The cylindrical section is sized and configured to surround the first drill rod when in the closed configuration. Furthermore, the first and second guide members form a frusta-conical section when the first and second jaws are in the closed configuration. The frusta-conical section is sized and configured to guide the second drill rod into the cylindrical section to align the axes of the first and second drill rods.

Furthermore, an implementation of a drilling system includes a mast and a drill head coupled to the mast. The drilling system also includes a drill rod clamping device coupled to the mast. The drill rod clamping device is configured to grip a first drill rod. Additionally, the drilling system includes a drill rod guide coupled to the drill rod clamping device. The drill rod guide includes a cylindrical section and a tapered section. The cylindrical section is configured to surround the first drill rod when gripped by the drill rod clamping device. While the tapered section is configured to guide a second drill rod into the cylindrical section to align the second drill rod with the first drill rod.

In addition to the foregoing, an implementation of a method of aligning a second drill rod with a first drill rod involves clamping an upper end of the first drill rod. The method also involves concentrically surrounding the upper end of the first drill rod with a cylindrical section of a drill rod guide. The method further involves positioning a lower end of the second drill rod into a tapered section of the drill rod guide. The method further involves lowering the second drill rod toward the first drill rod such that the tapered section of the drill rod guide directs the lower end of the second drill rod into the cylindrical section of the drill rod guide and into alignment with the first drill rod.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention are directed toward drilling tools, systems, and methods for effectively and efficiently aligning drill rods. For example, one or more implementations of the present invention include drill rod guides configured to align a first drill rod and a second drill. Such drill rod guides can reduce or eliminate damage to drill rods due to misalignment. Furthermore, such drill rod guides can be automated and function without the assistance of a drill operator. As such, drill rod guides of one or more implementations can increase safety, while also improving drilling efficiency.

In particular, one or more implementations can include a drill rod guide with a cylindrical section and a tapered or frusta-conical section. The cylindrical section can be sized and configured to concentrically surround a first drill rod. The tapered or frusta-conical section can be sized and configured to guide a second drill rod into the cylindrical section and into alignment with the first drill rod. The drill rod guide may include first and second guide members that form symmetrical halves of the drill rod guide. The first and second guide members may be connected to first and second jaws of the clamp. The guide may include a window configured to allow a user to visually confirm that the first and second drill rods are aligned.

Figure 1:
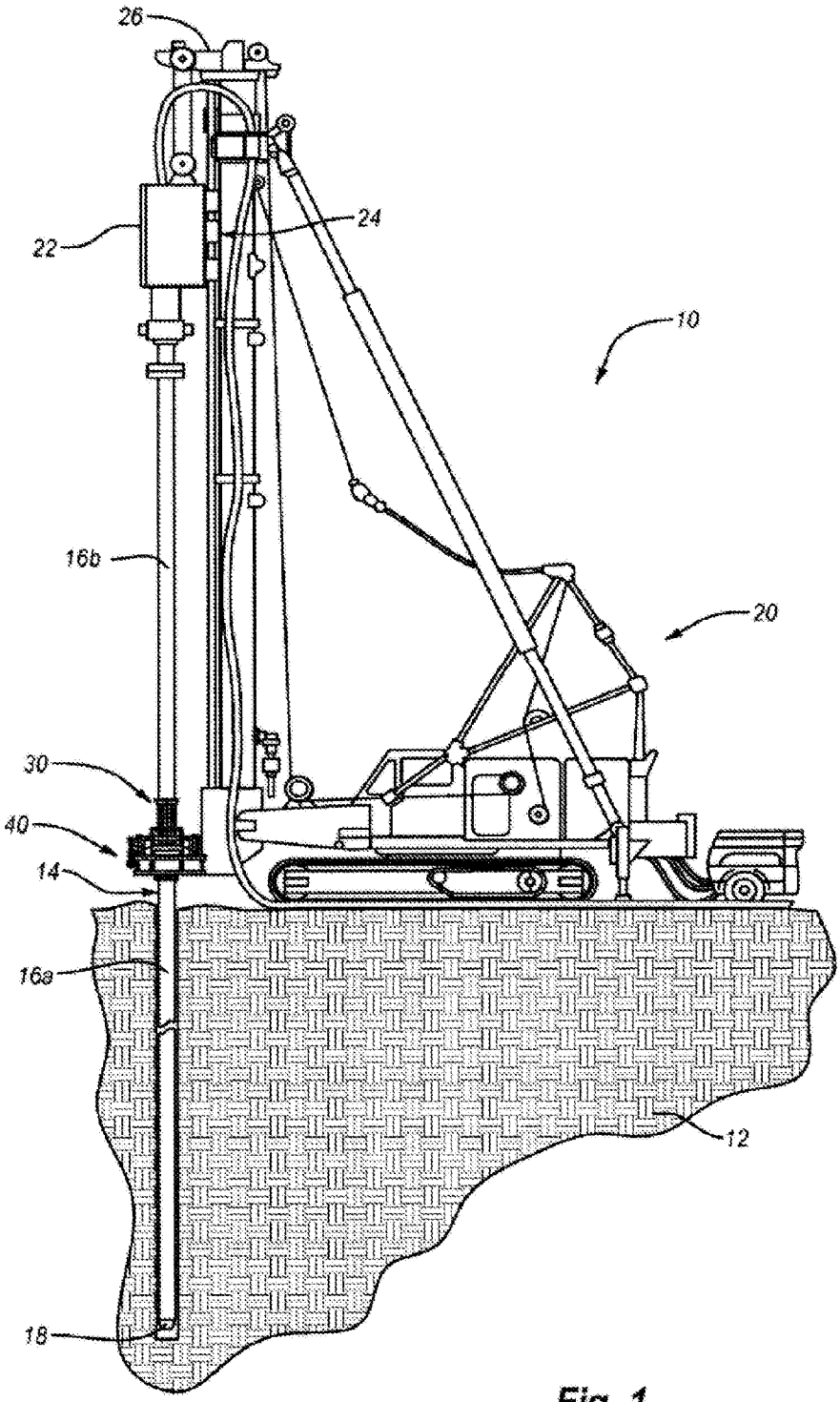
FIG. 1 illustrates schematic diagram of a drilling system including a clamping device and a drill rod guide in accordance with an implementation of the present invention.

As shown in FIG. 1, a drilling system 10 may be used to drill into a formation 12. The drilling system 10 may include a drill string 14 formed from a plurality of drill rods 16*a*, 16*b*. The drill rods 16*a*, 16*b* may be rigid and/or metallic, or alternatively may be constructed from other suitable materials. The drill string 14 may include a series of connected drill rods that may be assembled section-by-section as the drill string 14 advances into the formation 12. A drill bit 18 (for example, an open-faced drill bit or other type of drill bit) may be secured to the distal end of the drills string 14. As used herein the terms "down," "lower," "leading," and "distal end" refer to the end of the drill string 14 including the drill bit 18. While the terms "up," "upper," "trailing," or "proximal" refer to the end of the drill string 14 opposite the drill bit 18.

The drilling system 10 may include a drill rig 20 that may rotate and/or push the drill bit 18, the drill rods 16*a*, 16*b* and/or other portions of the drill string 14 into the formation 12. The drill rig 20 may include a driving mechanism, for example, a rotary drill head 22, a sled assembly 24, and a mast 26. The drill head 22 may be coupled to the drill string 14, and can rotate the drill bit 18, the drill rods 16*a*, 16*b* and/or other portions of the drill string 14. If desired, the rotary drill head 22 may be configured to vary the speed and/or direction that it rotates these components. The sled assembly 24 can move relative to the mast 26. As the sled assembly 24 moves relative to the mast 26, the sled assembly 24 may provide a force against the rotary drill head 22, which may push the drill bit 18, the drill rods 16*a*, 16*b* and/or other portions of the drill string 144 further into the formation 12, for example, while they are being rotated.

It will be appreciated, however, that the drill rig 20 does not require a rotary drill head, a sled assembly, a slide frame or a drive assembly and that the drill rig 20 may include other suitable components. It will also be appreciated that the drilling system 10 does not require a drill rig and that the drilling system 10 may include other suitable components that may rotate and/or push the drill bit 18, the drill rods 16*a*, 16*b* and/or other portions of the drill string 14 into the formation 12. For example, sonic, percussive, or down hole motors may be used.

As shown by FIG. 1, the drilling system 10 can further include a drill rod guide 30 and an associated drill rod clamping device 40 or clamp. As explained in greater detail below, the drill rod guide 30 can guide and align a first drill rod with a second drill rod to allow for connection of the first and second drill rods together. The drill rod guide 30 can ensure that the drill rods are not misaligned, and thus, avoid damage to the drill rods commonly associated with attempting to make (i.e., join) misaligned drill rods.

In further detail, the driving mechanism may advance the drills string 14 and particularly a first drill rod 16*a* until a trailing portion of the first drill rod 16*a* is proximate an opening of a borehole formed by the drill string 14. Once the first drill rod 16*a* is at a desired depth, the drill rod clamping device 40 may grasp the first drill rod 16*a*, which may help prevent inadvertent loss of the first drill rod 16*a* and the drill string 14 down the borehole. With the drill rod clamping device 40 grasping the first drill rod 16*a*, the driving mechanism may be disconnected from the first drill rod 16*a*.

An additional or second drill rod 16*b* may then be connected to the driving mechanism and advanced into the drill rod guide 30. The drill rod guide 30 may align the second drill rod 16*b* with the first drill rod 16*a* that forms the trailing portion of the drill string 14. In particular, the drill rod guide 30 may be configured to align the central axis of the second drill rod 16*b* with the central axis of the first drill rod 16*a*. Once aligned, a joint between the first drill rod 16*a* and the second drill rod 16*b* may be made by threading the second drill rod 16*b* into the first drill rod 16*a*.

After the second drill rod 16*b* is connected to the driving mechanism and the first drill rod 16*a*, the drill rod clamping device 40 may release the drill 14. The driving mechanism may advance the drill string 14 further into the formation to a greater desired depth. This process of grasping the drill string 14, disconnecting the driving mechanism, connecting an additional drill rod 16*b*, releasing the grasp, and advancing the drill string 14 to a greater depth may be repeatedly performed to drill deeper and deeper into the formation.

By aligning the drill rods 16*a*, 16*b*, the drill rod guide 30 may advantageously allow the drill rods 16*a*, 16*b* to be more quickly and easily connected with less risk of inadvertent damage to the drill rods 16*a*, 16*b*. For example, the first and second drill rods 16*a*, 16*b* may include threads configured to engage and mate to connect the drill rods 16*a*, 16*b*. By aligning the drill rods 16*a*, 16*b*, the drill rod guide 30 may allow the threads of the drill rods 16*a*, 16*b* to more quickly and easily engage with less risk of inadvertent damage to the threads.

One will appreciate in light of the disclosure herein that the one or more threads of the second drill rod 16*b* may be located on a pin or male portion at a leading portion of the drill rod 16*b*. Similarly, the one or more threads of the first drill rod 16*a* may be located in a box or female portion at the trailing portion of the drill rod 16*a*. It will be appreciated, however, that the threads may be formed in other suitable portions of the drill rods 16*a*, 16*b*, or the pins and boxes of the drill rods 16*a*, 16 b may be reversed. It will also be appreciated that the drill rods 16*a*, 16*b* do not require threads and may be connected using threads, fasteners, connectors, adhesives, welds and/or any other suitable means.

Figure 2:
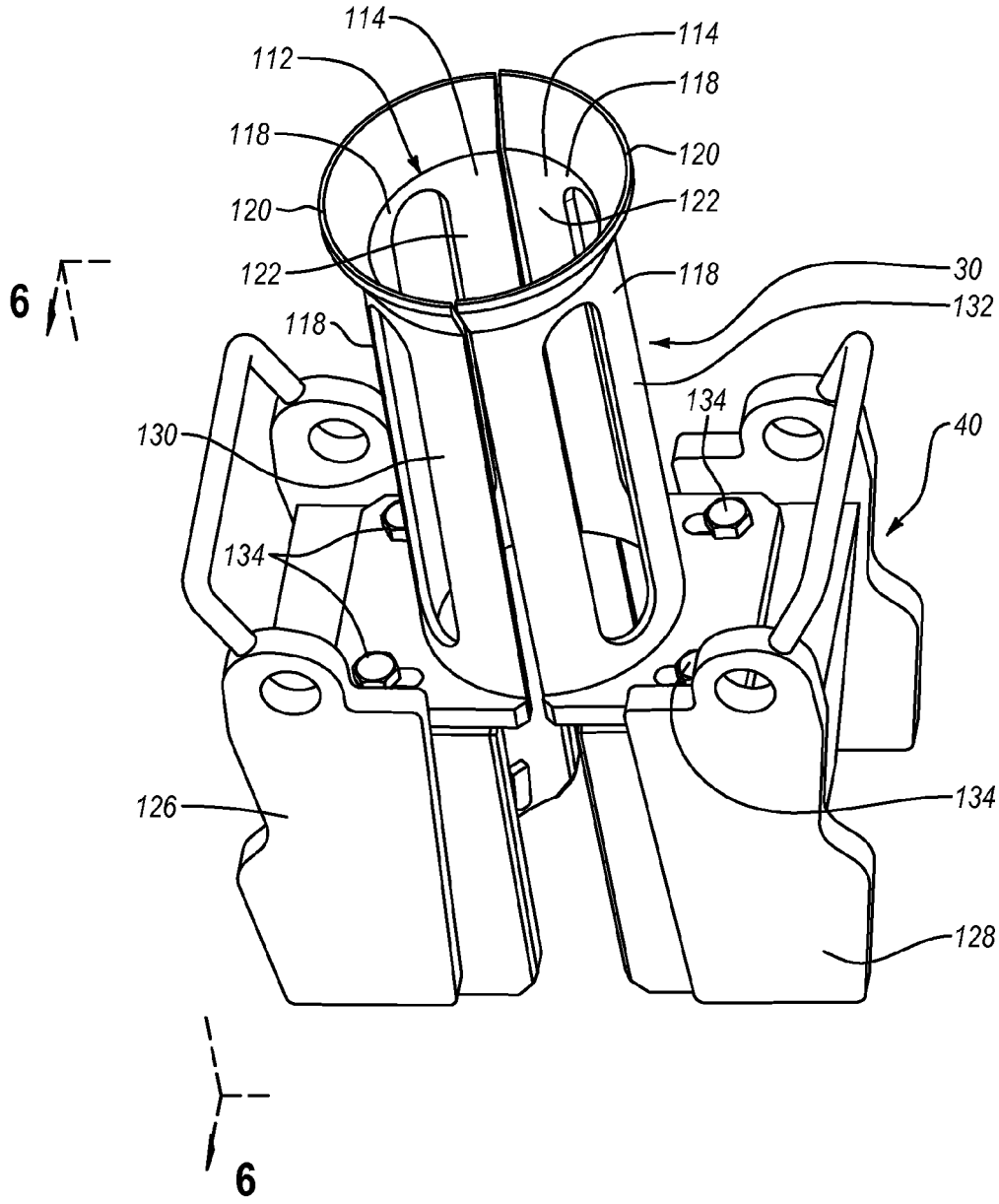
FIG. 2 illustrates a perspective view of a drill rod guide and clamping device in accordance with an implementation of the present invention.
Figure 3:
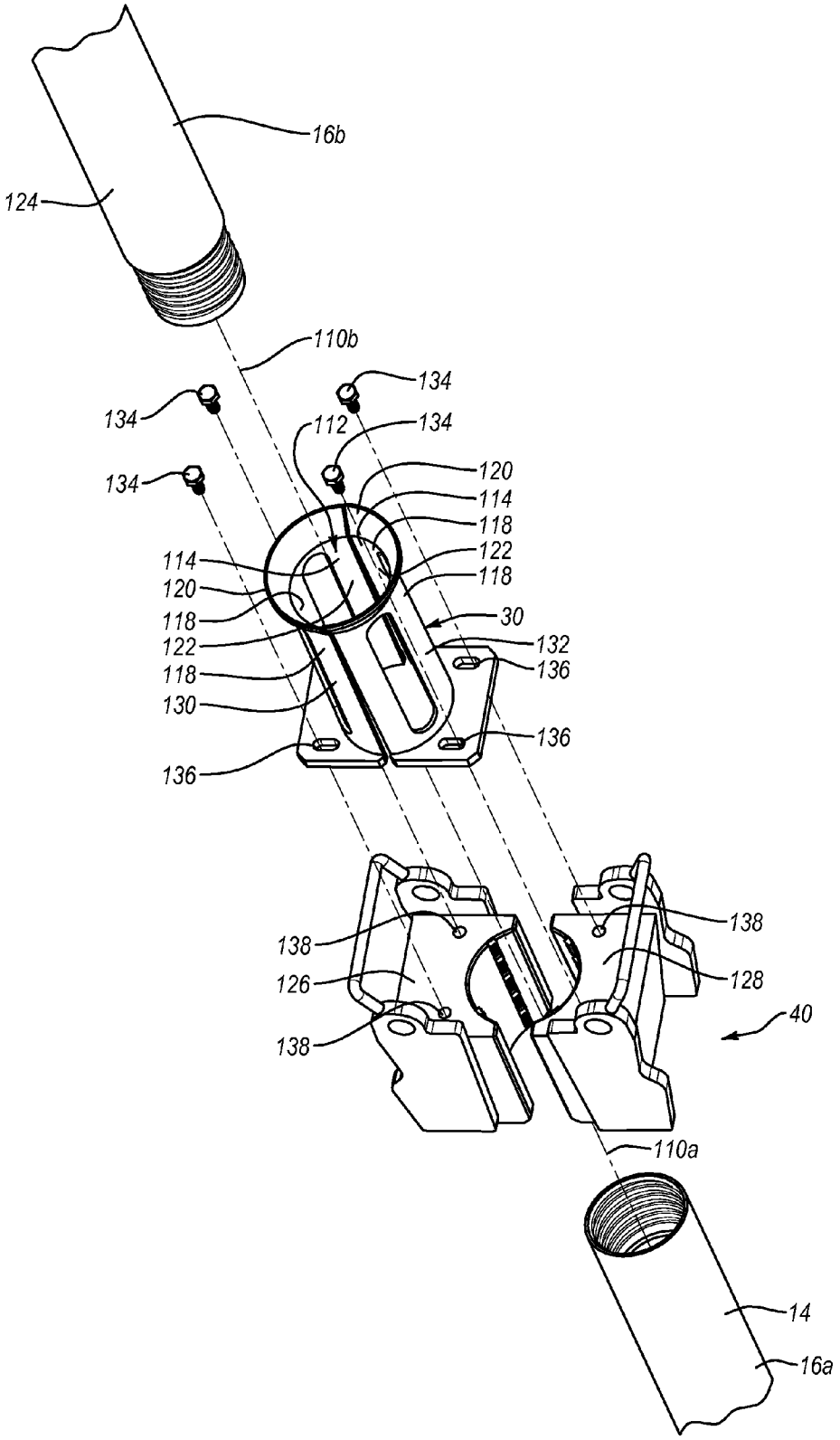
FIG. 3 illustrates an exploded view of the drill rod guide and clamping device of FIG. 2.

Referring now to FIGS. 2 and 3 more specifics of the drill rod guide 30 and associated drill rod clamping device 40 are shown. In particular, FIG. 2 illustrates that the drill rod guide 30 may include a receiving portion 112, which may be configured to receive a portion of the drill rod 16*a* to align the drill rods 16*a*, 16*b*. In particular, the drill rod guide 30 may include an interior surface 114 that defines the receiving portion 112 and is configured to contact and/or abut an exterior surface of the drill rod 16*a* to align the drill rods 16*a*, 16*b*.

In further detail, the drill rod guide 30 may include a first cylindrical section 118 and a second tapered or frusta-conical section 120 that may be configured to align the drill rods 16*a*, 16*b* by guiding a portion of the drill rod 16*a* into the cylindrical section 118. As discussed above, the drill rod clamping device 40 may grasp the drill rod 16*b* of the drill string 14, and the driving mechanism may be disconnected from the drill rod 16*a* of the drill string 14. With the drill rod clamping device 40 grasping the drill rod 16*a* and the driving mechanism disconnected from the drill rod 16*a*, a trailing portion of the drill rod 16*b* may be connected to the driving mechanism, and a leading portion of the drill rod 16*b* may be inserted into the receiving portion 112 of the drill rod guide 30.

As the leading portion of the drill rod 16*b* is inserted into the receiving portion 112, the frusta-conical section 120 may guide the leading portion of the drill rod 16*b* into the cylindrical section 118. The frusta-conical section 120 may, for example, taper toward the cylindrical section 118 and may contact and/or abut the drill rod 16*b* to guide the leading portion of the drill rod 16*b* into the cylindrical section 118. Guiding the leading portion of the drill rod 16*b* into the cylindrical section 118 may advantageously align the central axes 110*b*, 110*a* of the drill rods 16*b*, 16*a*. The aligned drill rods 16*b*, 16*a* may then be connected, the drill rod clamping device 40 may then release the drill rod 16*a*, and the drill string 14 may be advanced to a greater depth, as discussed above.

The cylindrical section 118 of the drill rod guide 30 may be configured to keep the drill rods 16*b*, 16*a* aligned. The cylindrical section 118 may keep the drill rods 16*b*, 16*a* aligned by, for example, contacting and/or abutting one or more portions of the drill rod 16*b* and/or the drill rod 16*a*. For example, the cylindrical section 118 may have a tubular shape, which may have a generally cylindrical interior surface that may be defined by one or more curved portions 122 of the section's interior surface 114. The curved portions 122 may be configured to contact and/or abut one or more curved portions 124 of the exterior surface of the drill rod 16*b* to keep the drill rods 16*b*, 16*a* aligned.

Figure 4:
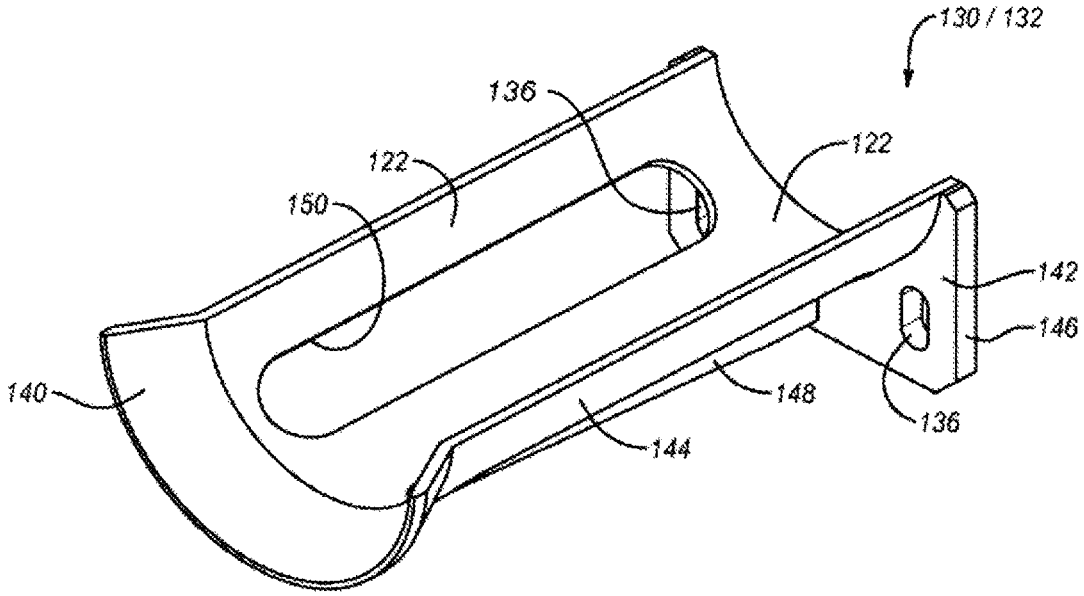
FIG. 4 illustrates an interior view of a guide member of a drill rod guide in accordance with an implementation of the present invention.

As shown in FIGS. 3 and 4, the generally cylindrical interior of the cylindrical section 118 may have a height that is greater than or equal to the diameter of the generally cylindrical interior of the cylindrical section 118, which may advantageously help the cylindrical section 118 more effectively keep the drill rods 16*b*, 16*a* aligned. For example, the generally cylindrical interior of the cylindrical section 118 may have a height that is at least 10 percent, 20 percent, 30 percent, 40 percent, 50 percent, 60 percent, 70 percent, 80 percent, 90 percent and/or 100 larger than the diameter of the generally cylindrical interior of the cylindrical section 118. It will be appreciated, however, that the drill rod 16*b* may have any suitable diameters that are larger or smaller. It will also be appreciated that the generally cylindrical interior of the cylindrical section 118 may have any suitable diameters and heights that are larger or smaller.

As shown in FIGS. 2 and 3, the tubular-shaped cylindrical section 118 and the tapered frusta-conical section 120 may form a funnel-shaped drill rod guide 30 that is configured to align the drill rods 16*b*, 16*a*. It will be appreciated, however, that the drill rod guide 30 does not require any tapered or frusta-conical section 120, that the drill rod guide 30 does not require a funnel shape, and that the drill rod guide 30 may have other suitable shapes configured to align the drill rods 16*b*, 16*a*. It will also be appreciated that the cylindrical section 118 does not require a tubular shape, does not require a generally cylindrical interior, and may have other suitable shapes configured to keep the drill rods 16*b*, 16*a* aligned. It will be further appreciated that the leading portion of the drill rod 16*b* may be inserted into the receiving portion 112 of the drill rod guide 30 automatically by machine or manually by hand and the drill rods 16*b*, 16*a* may be connected automatically by machine or manually by hand.

As shown in FIGS. 2 and 3, one or more portions of the drill rod guide 30 may be connected to one or more portions of the drill rod clamping device 40. As discussed below, this connection may help the drill rod guide 30 align the drill rods 16*b*, 16*a*. In further detail, the drill rod clamping device 40 may include a first jaw 126 and a second jaw 128. The drill rod guide 30 may include first and second guide members 130, 132, which may be fixed relative to the jaws 126, 128, respectively. For example, the guide member 130 may be fixedly connected to the jaw 126 using one or more fasteners 134 (such as bolts or other types of fasteners), and the guide member 132 may be fixedly connected to the jaw 128 using one or more fasteners 134 (such as bolts or other types of fasteners). To fixedly connect the guide members 130, 132 to the jaws 126, 128, the fasteners 134 may extend into openings 136 formed in the guide members 130, 132 and openings 138 formed in the jaws 126, 128. If desired, the openings 138 may be quickly and easily formed/machined into the jaws 126, 128 of existing clamps. It will be appreciated, however, that the fasteners 134 and the openings 136, 138 are not required and that the guide members 130, 132 may be fixedly connected to the jaws 126, 128 using fasteners, connectors, adhesives, welds and/or any other suitable means.

The guide members 130, 132 may be configured to be selectively connected to the jaws 126, 128 in any of a plurality of fixed relative positions. For example, the openings 136 in the guide members 130, 132 may have an elongate shape. The elongate shape of the openings 136 may allow the fasteners 134 to connect the guide member 130 to the jaw 126 in any of a plurality of fixed relative positions and connect the guide member 132 to the jaw 128 in any of a plurality of fixed relative positions.

The relative position of the guide members 130, 132 and the jaws 126, 128 may advantageously be selected and fixed so that the drill rod guide 30 can consistently align each additional drill rod 16*b* that is to be connected to the drill rod 16*a* that forms the trailing portion of the drill string 14. For example, the drill string 14 and the drill rods 104 may have an outer diameter, and the jaws 126, 128 of the drill rod clamping device 40 may be configured to consistently grasp that outer diameter. Consequently, the particular relative positions of the guide members 130, 132 and the jaws 126, 128 may be selected and fixed such that the drill rod guide 30 aligns the additional drill rod 16*b* with the drill rod 16*a* grasped by the jaws 126, 128 of the drill rod clamping device 40. Thereafter, because the drill string 14 and the drill rods 16*a*, 16*b* have the same outer diameter that the jaws 126, 128 consistently grasp, the drill rod guide 30 can consistently align each additional drill rod 16*b* with the drill rod 16*a* that forms the trailing portion of the drill string 14. If desired, the relative position of the guide members 130, 132 and the jaws 126, 128 may be changed and fixed so that the drill rod guide 30 can consistently align drill rods 16*a*, 16*b* that have a different second outer diameter.

In addition, the guide members 130, 132 of a first drill rod guide 30 may be connected to the jaws 126, 128 of the drill rod clamping device 40 so that the first drill rod guide 30 can consistently align drill rods 104 that have a first outer diameter. After their use, the guide members 130, 132 of the first drill rod guide 30 may subsequently be disconnected from the jaws 126, 128 of the drill rod clamping device 40, and the guide members 130, 132 of a second drill rod guide 30 may be connected to the jaws 126, 128 of the drill rod clamping device 40 so that the second drill rod guide 30 can consistently align drill rods 16*a*, 16*b* that have a second outer diameter that is different from the first outer diameter. Thus, a variety of different drill rod guides 30 may be connected to the drill rod clamping device 40 and used to align drill rods 16*a*, 16*b* that have a variety of different diameters.

Figure 5:
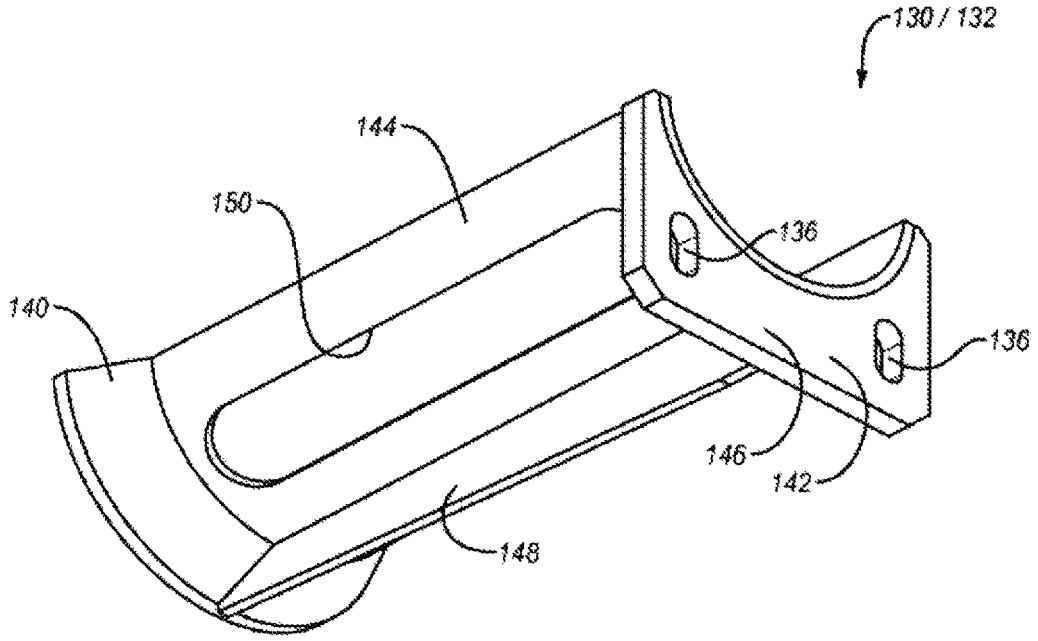
FIG. 5 illustrates an exterior view of the guide member of FIG. 7 in accordance with an implementation of the present invention.

Referring now to FIGS. 4 and 5 more details of the guide members of the drill rod guide 30 are shown and described. The guide members 130, 132 may include a first end portion 140 that may form part of the frusta-conical section 120, an opposing second end portion 142, and an intermediate portion 144 that may form a portion of the cylindrical section 118. The intermediate portion 144 may have a half-pipe shape that may include the curved portions 122 discussed above. As shown by FIGS. 4 and 5, in at least one implementation the curved portions 122 can extend away from the second end portion 142 in a direction perpendicular to a bottom face or surface of the flange 146. The end 142 of the guide members 130, 132 may include a flange 146 that may include the openings 136. The guide members 130, 132 may also include a gusset 148 that may be connected to the first end portion 140, the intermediate portion 144, and/or the flange 146 of the end portion 142. Desirably, the gusset 148 may be configured to strengthen and/or reinforce the guide members 130, 132.

The guide members 130, 132 may form a clamshell configuration that is configured to align the drill rods 16*b*, 16*a*. In particular, the guide members 130, 132 may form first and second symmetrical halves of the drill rod guide 30. In addition, the guide members 130, 132 may be interchangeable, such that the guide members 130, 132 may be interchangeably connectable to the jaws 126, 128. It will be appreciated, however, that the guide members 130, 132 need not be interchangeable and need not form symmetrical halves of the clamshell configuration. It will also be appreciated that the drill rod guide 30 does not require a clamshell configuration and may have other suitable configurations.

One will appreciate that the inner surfaces 114 of the intermediate portions 144 of each of the first and second guide members 130, 132 can form a cylindrical inner surface when the first and second guide members are abutted together, as shown in FIG. 2. Similarly, the inner surfaces 114 of the first end portions 140 of the first and second guide members 130, 132 can form a frusta-conical inner surface when the first and second guide members 130, 132 are abutted together as shown in FIG. 2. Furthermore, the inner surfaces of the first end portions 140 of the first and second guide members 130, 132 can extend radially outward and axially away from the intermediate portions 144 of the first and second guide members 130, 132.

FIGS. 4 and 5 further illustrate that the drill rod guide 30 may include one or more windows 150, which may allow a user to visually confirm that the drill rods 16*b*, 16*a* are aligned. In addition, if the drill rods 16*b*, 16*a* include threads as discussed above, the one or more windows 150 may allow a user to visually confirm that the threads of the drill rods 16*b*, 16*a* are aligned and/or engaged. As shown in FIGS. 4 and 5, the windows 150 may have an elongate shape and may be disposed in the cylindrical section 118 of the drill rod guide 30 and/or the intermediate portion 144 of the guide members 130, 132. It will be appreciated, however, that the windows 150 may have other shapes and may be disposed in other locations. It will also be appreciated that the drill rod guide 30 does not require any windows 150.

Figure 6:
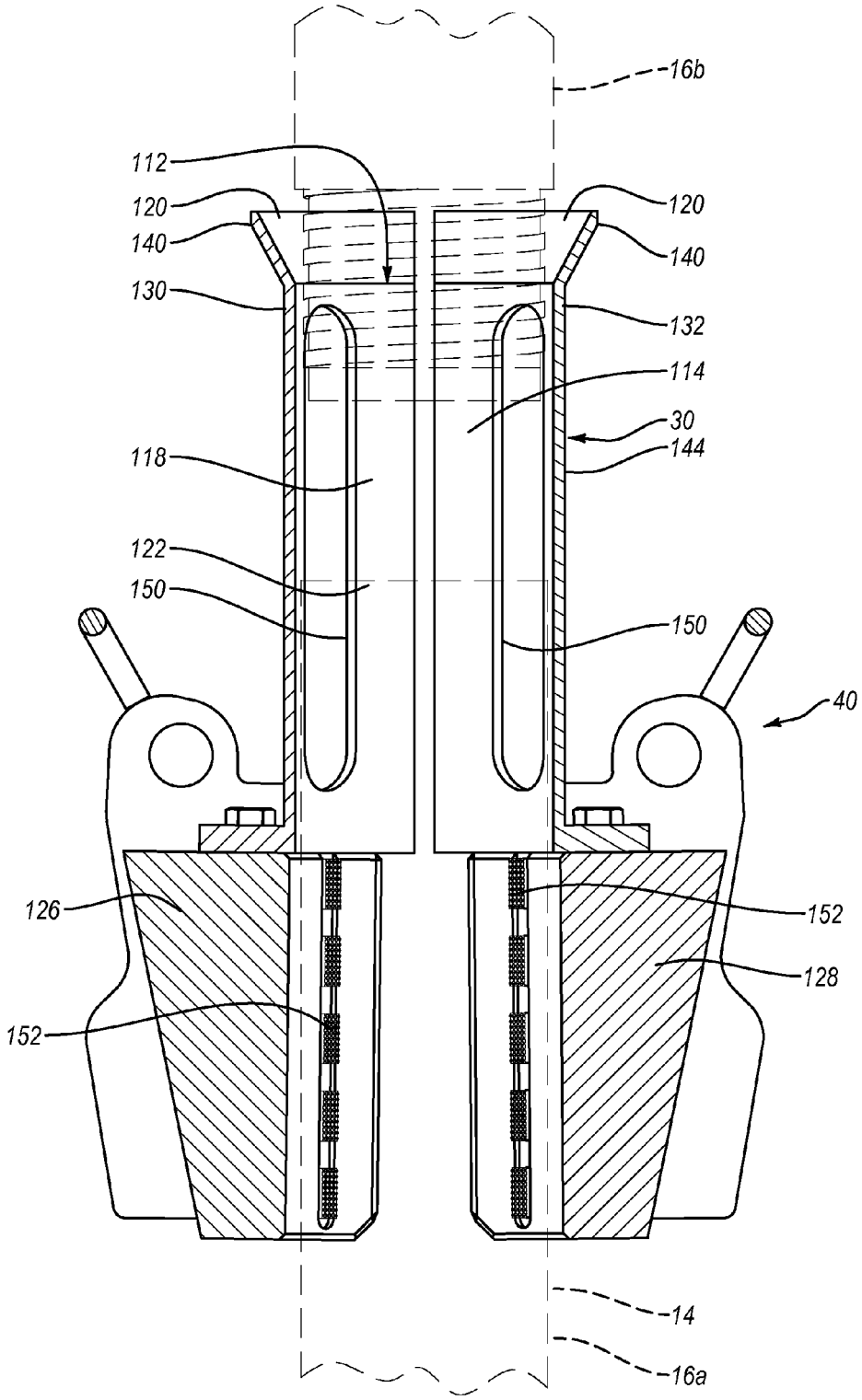
FIG. 6 illustrates a cross-sectional view of the drill rod guide and clamping device of FIG. 2 taken along the line 6-6 of FIG. 2.

Referring now to FIG. 6, a view of a second drill rod 16*b* being inserted into the drill rod guide 30 and aligned with the first drill rod 16*a* is illustrated. As shown by FIG. 6, the first drill rod 16*a* is clasped by the drill rod clamping device 40. In particular, gripping inserts 152 on each of the jaws 126, 128 can grip and hold the first drill rod 16*a*. The gripping inserts 152 can comprise any number of materials that are wear resistant. For example, in one or more implementations the gripping inserts 152 comprise tungsten carbide inserts. FIG. 6 illustrates rows of four gripping inserts 152. In alternative implementations, each row can comprise a single gripping insert 152, 2, 3, 5, 6 or more gripping inserts. Furthermore, each jaw 126, 128 can comprise two, three, four, or more rows of gripping inserts 152. This arrangement can allow for increased frictional contact can provide better load transmission, thus increasing capacity and safety while decreasing wear on the associated components.

As shown by FIG. 6, the generally cylindrical interior of the cylindrical section 118 may have a diameter that is slightly larger than an outer diameter of the drill rod 16*a*. For example, the generally cylindrical interior of the cylindrical section 118 may have a diameter that is less than about 10 millimeters, 9 millimeters, 8 millimeters, 7 millimeters, 6 millimeters, 5 millimeters, 4 millimeters, 3 millimeters, 2 millimeters, and/or 1 millimeter larger than the outer diameter of the drill rod 16*a*. For instance, in one embodiment, the generally cylindrical interior of the cylindrical section 118 may have a diameter that is about 90 millimeters and the drill rod 16*a* may have an outer diameter that is about 88.9 millimeters. One will appreciate that a relatively tight tolerance between the inner diameter of the cylindrical section 118 and the drill rods 16*a*, 16*b* can help ensure that the drill rods 16*a*, 16*b* are properly aligned.

As discussed above, a trailing or upper end of the first drill rod 16*a* may be clamped between the jaws 126, 128 of the drill rod clamping device 40. By so doing the cylindrical portion 118 of the drill rod guide 30 can concentrically surround the upper end of the first drill rod 16*a*. In particular, the two symmetrical halves 130, 132 of the drill rod guide 30 can be closed about the first drill rod 16*a*. Thus, as shown in FIG. 6, when the drill rod clamping device 40 grasps the drill 16*a*, a trailing portion of the drill rod 16*a* may be positioned within the receiving portion 112 of the drill rod guide 30.

A lower end of the second drill rod 16*b* can be positioned into the receiving portion 112 of the drill rod guide 30. In other words, the lower end of the drill rod 16*b* can be positioned into the tapered or frusta-conical section 120 of the drill rod guide 30. As the second drill rod 16*b* is lowered toward the first drill rod 16*a*, the tapered section 120 of the drill rod guide 30 can direct the lower end of the second drill rod 16*b* into the cylindrical section 118 of the drill rod guide 30 and into alignment with the first drill rod 16*a*. In other words, tapered section 120 of the drill rod guide 30 can direct the drill rod 16*b* into the cylindrical portion 118 of the drill rod guide 30 so that the drill rod guide 30 concentrically surrounds the lower end of the second drill rod 16*b*.

At this point, the second drill rod 16*b* can be threaded into the first drill rod 16*a*. In particular, the threaded pin end of the second drill rod 16*b* can be inserted and rotated relative to the internally thread box end of the first drill rod 16*a*. Once the drill rods 16*a*, 16*b* are connected together, the first drill rod 16*a* can be released by opening the drill rod clamping device 30 thereby separating the drill rod guide into symmetrical halves 130, 132.

The jaw 126 and the guide member 130 may be configured to move in unison and the jaw 128 and the guide member 132 may be configured to move in unison as the drill rod guide 30 and the drill rod clamping device 40 are opened and closed. For example, the guide members 130, 132 may be fixedly connected to the jaws 126, 128, respectively. In particular, to grasp the drill rod 16*a*, the jaw 126 and the guide member 130 may move in unison towards the drill rod 16*a*, and the jaw 128 and the guide member 132 may move in unison towards the drill rod 16*a*. Also, to release the grasp and thus allow the drill string 14 to drill further into the formation, the jaw 126 and the guide member 130 may move in unison away from the drill rod 16*a*, and the jaw 128 and the guide member 132 may move in unison away from the drill rod 16*a*.

One will appreciate in light of the disclosure herein that the inner surface of the guide member 130 is concentric to the inner surface of the jaw 126. Similarly, the inner surface of the guide member 132 is concentric to the inner surface of the jaw 128. By being concentric with the jaws 126, 128, the guide members 130, 132 can ensure that a drill rod is properly aligned.

Figure 7:
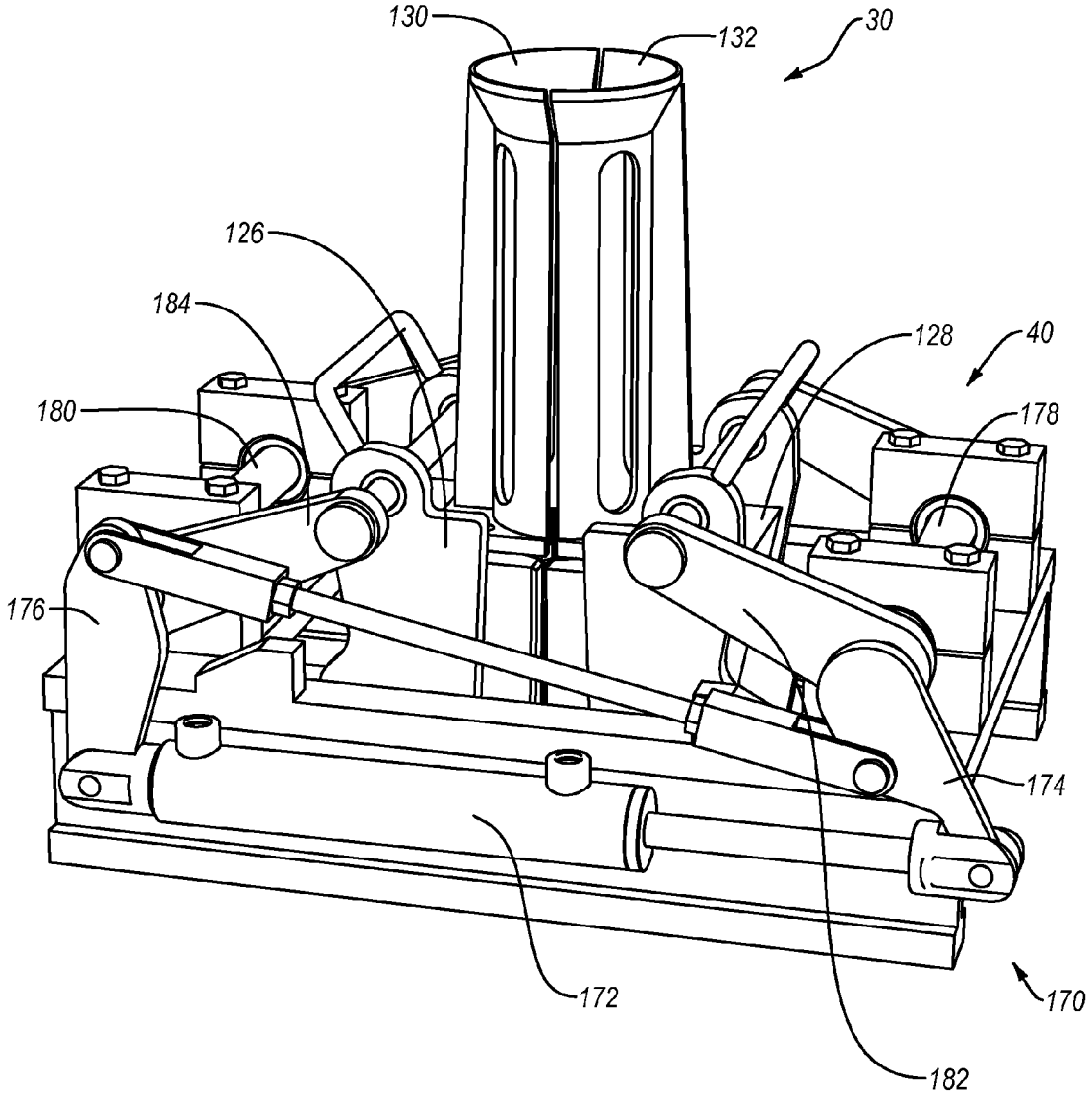
FIG. 7 illustrates a view of the clamping device and drill rod guide in a closed configuration in accordance with an implementation of the present invention.
Figure 8:
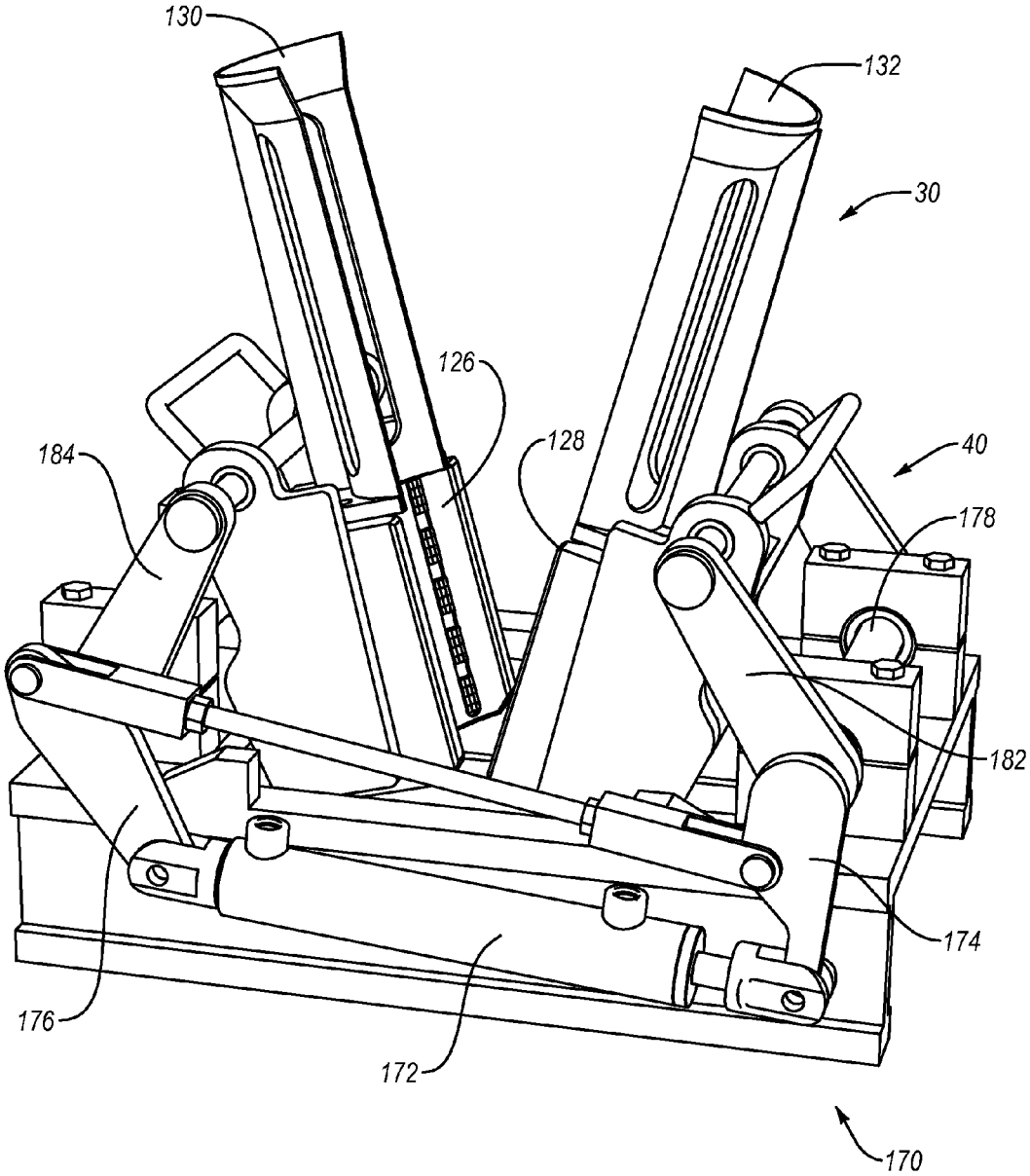
FIG. 8 illustrates the clamping device and drill rod guide of FIG. 7, albeit in an open configuration in accordance with an implementation of the present invention.

In one or more implementations, the drill rod clamping device 40 can further include an actuation mechanism that automatically open and closes the drill rod clamping device 40 and the drill rod guide 30. For example, FIGS. 7 and 8 illustrates one implementation of an actuation mechanism 170 for opening and closing the drill rod clamping device 40 and the drill rod guide 30. As shown in FIGS. 7 and 8, the actuation mechanism 170 can include a linkage system that pivots the first and second jaws 126, 128 toward and away from each other.

In particular, as a cylinder 172 of the actuation mechanism 170 is expanded and refracted, first and second linkages 174, 176 can rotate and cause pivots 178, 180 to simultaneously rotate. The rotation of the pivots 178, 180 can cause linkage arms 182, 184 connecting the jaws 126, 128 to the pivots 178, 180 to rotate thereby pivoting the jaws 126, 128 and guide members 130, 132 between open (FIG. 8) and closed configurations (FIG. 7).

The present invention can thus be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A drill rod guide for aligning a second drill rod with a first drill rod to allow the second drill rod to be secured to the first drill rod, comprising:

a first guide member comprising a second end portion having one or more elongate openings configured to receive one or more fasteners to connect the first guide member to a clamp in any of a plurality of fixed relative positions; and a second guide member, wherein each of the first and second guide members comprises a first end portion having a first inner surface, and an intermediate portion having a second inner surface, wherein the second guide member is configured to move relative to the first guide member and wherein the second guide member comprises a second end portion having one or more elongate openings configured to receive one or more fasteners to connect the second guide member to a clamp in any of a plurality of fixed relative positions;

wherein the second inner surfaces of the intermediate portions of the first and second guide members form a cylindrical inner surface when the first and second guide members are abutted together; and wherein the first inner surfaces of the first end portions of the first and second guide members form a frusta-conical inner surface when the first and second guide members are abutted together.

2. The drill rod guide as recited in claim 1, wherein the first inner surfaces of the first end portions of the first and second guide members extend radially outward and axially away from the intermediate portions of the first and second guide members.

3. The drill rod guide as recited in claim 1, wherein the intermediate portions of the first and second guide members have a tubular shape when abutted together.

4. The drill rod guide as recited in claim 1, wherein the first and second guide members form a clamshell configuration.

5. The drill rod guide as recited in claim 4, wherein the first and second guide members form symmetrical halves of the clamshell configuration.

6. The drill rod guide as recited in claim 1, wherein the intermediate portion of the first guide member includes a window configured to allow a user to view one or more drill rods positioned within the first and second guide members when abutted together.

7. The drill rod guide as recited in claim 1, further comprising a first gusset secured to an outer surface of the first guide member.

8. The drill rod guide as recited in claim 7, further comprising a second gusset secured to an outer surface of the second guide member.

9. A drill rod clamping device for aligning a second drill rod with a first drill rod to allow the second drill rod to be secured to the first drill rod, comprising:

a first jaw;

a second jaw, the first and second jaws being configured to move between an open configuration and a closed configuration, wherein the first and second jaws are sized and configured to grip the first drill rod when in the closed configuration; and a drill rod guide comprising a first guide member coupled to the first jaw, and a second guide member coupled to the second jaw;

wherein the first and second guide members form a cylindrical section defining one or more windows when the first and second jaws are in the closed configuration, the cylindrical section being sized and configured to surround the first drill rod when in the closed configuration, and wherein the first and second guide members form a frusta-conical section when the first and second jaws are in the closed configuration, the frusta-conical section being sized and configured to guide the second drill rod into the cylindrical section to align the axes of the first and second drill rods.

10. The drill rod clamping device as recited in claim 9, further comprising an actuation mechanism for automatically moving the first and second jaws between the open configuration and the closed configuration.

11. The drill rod clamping device as recited in claim 10, wherein the actuation mechanism comprises a linkage system that pivots the first and second jaws toward and away from each other.

12. The drill rod clamping device as recited in claim 9, wherein the first and second guide members form symmetrical halves of the drill rod guide.

13. The drill rod clamping device as recited in claim 9, wherein the cylindrical section of said drill guide is configured to be concentric to the first drill rod when the first and second jaws are in the closed configuration.

14. The drill rod clamping device as recited in claim 9, further comprising one or more gussets secured to an outer surface of the drill rod guide.

15. A drilling system for aligning and connecting a second drill rod with a first drill rod, comprising:

a mast;

a drill head coupled to the mast;

a drill rod clamping device coupled to the mast, the drill rod clamping device configured to grip the first drill rod;

a drill rod guide coupled to the drill rod clamping device, the drill rod guide comprising a cylindrical section and a tapered section; and an actuation mechanism for automatically moving the drill rod clamping device and the drill rod guide between an open configuration and a closed configuration;

wherein the cylindrical section is configured to surround the first drill rod when gripped by the drill rod clamping device, and wherein the tapered section is configured to guide a second drill rod into the cylindrical section to align the second drill rod with the first drill rod.

16. The drilling system as recited in claim 15, wherein the drill rod guide comprises: a first guide member comprising a first end portion and an intermediate portion; and a second guide member comprising a first end portion and an intermediate portion, the second guide member being configured to move relative to said the first guide member; wherein: inner surfaces of the intermediate portions of the first and second guide members form the cylindrical section when the first and second guide members are abutted together; and inner surfaces of the first end portions of the first and second guide members form the tapered section when the first and second guide members are abutted together.

17. The drilling system as recited in claim 16, wherein the first and second guide members form symmetrical halves of the drill rod guide.

18. The drilling system as recited in claim 15, wherein the cylindrical section includes a window configured to allow a user to view the first and second drill rods positioned within the drill rod guide.

19. A method for aligning a second drill rod with a first drill rod, comprising:

providing a drill rod clamping device comprising:

a first jaw;

a second jaw, the first and second jaws being configured to move between an open configuration and a closed configuration, wherein the first and second jaws are sized and configured to grip the first drill rod when in the closed configuration;

a drill rod guide comprising a first guide member coupled to the first jaw, and a second guide member coupled to the second jaw; and an actuation mechanism for automatically moving the first and second jaws between the open configuration and the closed configuration, wherein the actuation mechanism comprises a linkage system that pivots the first and second jaws toward and away from each other;

wherein the first and second guide members form a cylindrical section when the first and second jaws are in the closed configuration, the cylindrical section being sized and configured to surround the first drill rod when in the closed configuration, and wherein the first and second guide members form a frusta-conical section when the first and second jaws are in the closed configuration, the frusta-conical section being sized and configured to guide the second drill rod into the cylindrical section to align the axes of the first and second drill rods;

clamping an upper end of the first drill rod; concentrically surrounding the upper end of the first drill rod with the cylindrical section;

positioning a lower end of the second drill rod into the frusta-conical section of the drill rod guide; and lowering the second drill rod toward the first drill rod such that the frusta-conical section of the drill rod guide directs the lower end of the second drill rod into the cylindrical section and into alignment with the first drill rod.

20. The method as recited in claim 19, further comprising threading the second drill rod to the first drill rod.

21. The method as recited in claim 19, further comprising releasing the first drill rod by moving the actuation mechanism to the open configuration thereby separating the drill rod guide into symmetrical halves.

22. The method as recited in claim 19, wherein concentrically surrounding the upper end of the first drill rod with the cylindrical section of a drill rod guide comprises closing the first and second jaws into the closed.

23. A drill rod clamping device for aligning a second drill rod with a first drill rod to allow the second drill rod to be secured to the first drill rod, comprising:

a first jaw;

a second jaw, the first and second jaws being configured to move between an open configuration and a closed configuration, wherein the first and second jaws are sized and configured to grip the first drill rod when in the closed configuration;

a drill rod guide comprising a first guide member coupled to the first jaw, and a second guide member coupled to the second jaw; and an actuation mechanism for automatically moving the first and second jaws between the open configuration and the closed configuration, wherein the actuation mechanism comprises a linkage system that pivots the first and second jaws toward and away from each other;

wherein the first and second guide members form a cylindrical section when the first and second jaws are in the closed configuration, the cylindrical section being sized and configured to surround the first drill rod when in the closed configuration, and wherein the first and second guide members form a frusta-conical section when the first and second jaws are in the closed configuration, the frusta-conical section being sized and configured to guide the second drill rod into the cylindrical section to align the axes of the first and second drill rods.

24. The drill rod clamping device as recited in claim 23, wherein the first and second guide members form symmetrical halves of the drill rod guide.

* * * * *